US009749728B2

(12) United States Patent
Wolf et al.

(10) Patent No.: US 9,749,728 B2
(45) Date of Patent: Aug. 29, 2017

(54) AUDIO HEADSET ACCOMMODATING EAR GEOMETRY VARIATIONS

(71) Applicant: Microsoft Corporation, Redmond, WA (US)

(72) Inventors: Monika Wolf, Seattle, WA (US); Austin Porter, Seattle, WA (US); Eric J. Wahl, Kirkland, WA (US); Aditha May Adams, Seattle, WA (US); Patrick Gaule, Bothell, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 95 days.

(21) Appl. No.: 14/281,581

(22) Filed: May 19, 2014

(65) Prior Publication Data

US 2014/0363012 A1 Dec. 11, 2014

Related U.S. Application Data

(60) Provisional application No. 61/832,681, filed on Jun. 7, 2013.

(51) Int. Cl.
*H04R 1/10* (2006.01)

(52) U.S. Cl.
CPC ..... *H04R 1/1041* (2013.01); *H04R 1/10* (2013.01)

(58) Field of Classification Search
CPC ..... H04R 1/10; H04R 1/1041; H04R 1/083; H04R 1/1066; H04M 1/02; H04M 1/03
See application file for complete search history.

(56) References Cited

U.S. PATENT DOCUMENTS

| | | | | |
|---|---|---|---|---|
| 4,634,816 | A * | 1/1987 | O'Malley | H04M 1/05 381/371 |
| 4,875,233 | A | 10/1989 | Derhaag et al. | |
| 5,185,807 | A | 2/1993 | Bergin et al. | |
| 5,293,647 | A | 3/1994 | Mirmilshteyn et al. | |
| 5,381,486 | A | 1/1995 | Ludeke et al. | |
| 6,016,347 | A * | 1/2000 | Magnasco | H04R 1/1041 379/430 |
| 7,519,196 | B2 * | 4/2009 | Bech | H04R 1/105 381/370 |
| 8,050,444 | B2 | 11/2011 | Smith | |
| 2007/0081690 | A1 * | 4/2007 | Stagni | H04R 1/028 381/384 |

(Continued)

FOREIGN PATENT DOCUMENTS

GB 2159366 A 11/1985

OTHER PUBLICATIONS

"International Search Report and Written Opinion Received for Patent Application No. PCT/US2014/041084", Mailed Date: Oct. 7, 2014, 11 Pages.

(Continued)

*Primary Examiner* — Thang Tran
(74) *Attorney, Agent, or Firm* — Vierra Magen Marcus LLP

(57) ABSTRACT

An audio headset is disclosed. In examples, the audio headset is linearly and rotationally adjustable about multiple axes to ensure optimal fit over a user's ear and optimal audio quality. The audio headset further includes a microphone for accepting audio from the user. The microphone is also rotationally adjustable about multiple axes to ensure optimal positioning and comfort for the user.

20 Claims, 24 Drawing Sheets

(56) References Cited

U.S. PATENT DOCUMENTS

| | | | | |
|---|---|---|---|---|
| 2007/0183616 | A1 | 8/2007 | Wahl et al. | |
| 2007/0184881 | A1* | 8/2007 | Wahl | H04M 1/05 455/575.2 |
| 2007/0202950 | A1 | 8/2007 | Hussaini et al. | |
| 2010/0040240 | A1* | 2/2010 | Bonanno | H04R 5/033 381/74 |
| 2010/0040252 | A1* | 2/2010 | Thompson | H04R 1/083 381/375 |
| 2012/0014553 | A1* | 1/2012 | Bonanno | H04R 5/033 381/364 |
| 2012/0070027 | A1* | 3/2012 | Ridler | H04R 1/1058 381/374 |
| 2014/0003646 | A1* | 1/2014 | Andersen | H04R 1/08 381/375 |
| 2014/0153405 | A1* | 6/2014 | Pane | H04L 65/1059 370/241 |

OTHER PUBLICATIONS

Wemanis, et al., "Development of a user-centred gaming headset", Master's Thesis in Industrial Design Engineering, Mar. 22, 2013, 82 pages.

"Is there going to be new model of beats headphones coming out?" Published on: Aug. 8, 2013 Available at: http://beatsstereo.jigsy.com/entries/general/is-there-going-to-be-new-model-of-beats-headphones-coming-out.

Bor-Shong Liu, "Incorporating anthropometry into design of ear-related products", Department of Industrial Engineering and Management, St. John's University, Dec. 11, 2006, 7 pages.

"International Preliminary Report on Patentability Issued in PCT Application No. PCT/US2014/041084", Mailed Date: Aug. 28, 2015, 8 Pages.

* cited by examiner

AUDIO HEADSET ACCOMMODATING EAR GEOMETRY VARIATIONS

PRIORITY CLAIM

This application claims priority to U.S. Provisional Patent Application No. 61/832,681, filed Jun. 7, 2013, entitled, "System and Method for Accommodating Ear Geometry Variation in an Audio Headset," which is incorporated herein by reference in its entirety.

BACKGROUND

Gaming audio headsets are deemed functionally successful when high quality audio is comfortably delivered to the ears for long periods of time. High quality audio benefits from a separation of game audio from the surrounding ambient audio environment. Ear cup orientation is typically fixed, or occurs along a single axis, and padding is typically used to seal the ambient sounds external to the ear.

When the seal is incomplete, both the game audio and the long term comfort are compromised, because ambient sound is let into the ear cup chamber and points of friction and pressure develop where the ear cups contact the flesh of the ear (pinna). Comfort and audio performance can be greatly improved by increasing the flexibility of the contact surface between the ear and the headset cups. The great variety of planar relationships in consumer ear anatomy has made the problem of good fitting ear cups worse outside of custom solutions.

SUMMARY

Embodiments of the present technology relate to an audio headset. In examples, the audio headset is linearly and rotationally adjustable about multiple axes to ensure optimal fit over a user's ear and optimal audio quality. The audio headset further includes a microphone for accepting speech from the user. The microphone is also rotationally adjustable about multiple axes to ensure optimal positioning and comfort for the user.

In one example, the present technology relates to an audio headset, comprising: a headband having a portion defining a first axis along a length of the portion; an ear pod affixed at the portion of the headband, the ear pod including a speaker and mounted for translation along the axis and rotation about the axis, a second axis being defined orthogonal to the first axis and substantially perpendicular to a major planar surface of the ear pod; and a microphone affixed to the headband at the ear pod, wherein the microphone is mounted for rotation about the second axis.

In a further example, the present technology relates to an audio headset, comprising: a headband having a portion defining a first axis along a length of the portion; a housing affixed at the portion of the headband, the housing having a cover with an elongate slot formed along the first axis; a slide mounted within the housing; a slide base affixed to the slide; an ear pod including a speaker, the ear pod affixed to the slide base, the slide, slide base and ear pod capable of translating together along the first axis along the length of the slot, and the slide, slide base and ear pod capable of rotating together around the first axis within the slot, a second axis being defined orthogonal to the first axis and substantially perpendicular to a major planar surface of the ear pod; and a microphone affixed to the ear pod, wherein the microphone is mounted for rotation relative to the ear pod about the second axis.

In another example, the present technology relates to an audio headset assembly, comprising: a headset, comprising: a headband having a portion defining a first axis along a length of the portion, an ear pod affixed at the portion of the headband, the ear pod including a speaker and mounted for translation along the axis and rotation about the axis, a second axis being defined orthogonal to the first axis and substantially perpendicular to a major planar surface of the ear pod, and a microphone affixed to the headband at the ear pod, wherein the microphone is mounted for rotation about the first and second axes; and a volume controller for controlling a volume to the ear pod and a mute function for muting the microphone.

DETAILED DESCRIPTION

The present technology will now be described with reference to the figures which in general relate to an audio headset which is linearly and rotationally adjustable about multiple axes to ensure optimal fit over a user's ear and optimal audio quality. In one example, the headset may be used for gaming applications. However, the headset according to the present technology may also be used in other applications, including for example, helmet radio ear pieces, pilot communications, and two-way radio ear pieces.

Figure 1:
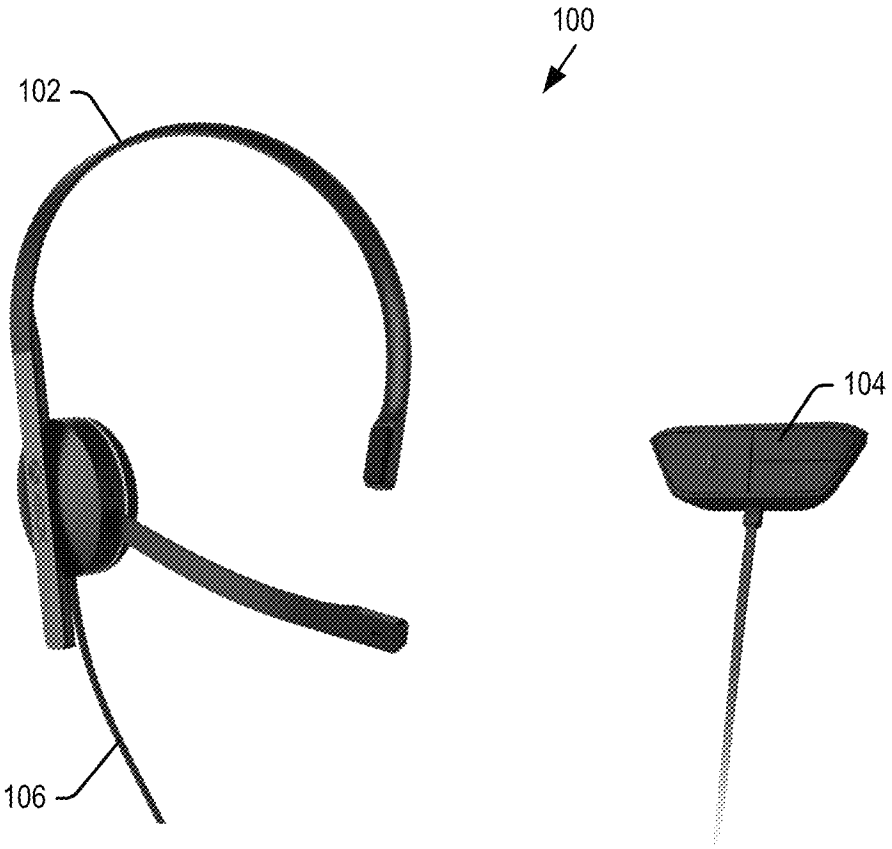
FIG. 1 is a perspective view of a headset assembly including a headset and a volume controller.
Figure 2:
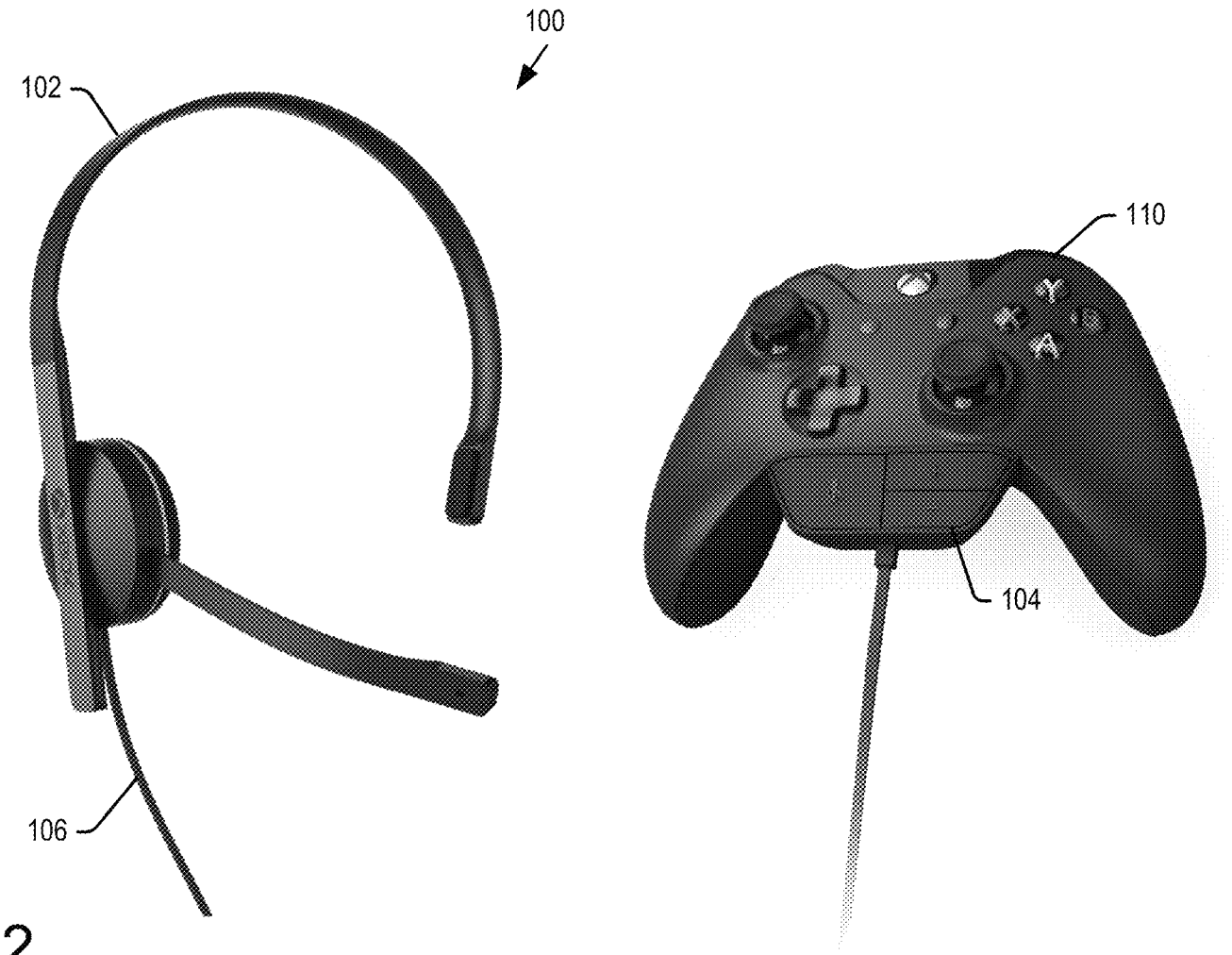
FIG. 2 is a perspective view of a headset assembly including a headset and a volume controller affixed to a game controller.

FIG. 1 illustrates an audio headset assembly 100 including a headset 102, a volume controller 104 and a cord 106 (partially shown) connecting the headset 102 to the volume controller 104. Headset 102 may communicate with volume controller 104 wirelessly in further embodiments. FIG. 2 illustrates the headset assembly 100 with volume controller 104 plugged into a game controller 110. FIGS. 3-12 illustrate additional views of the headset 102, some of which figures include text describing additional features of the headset 102.

Figure 3B:
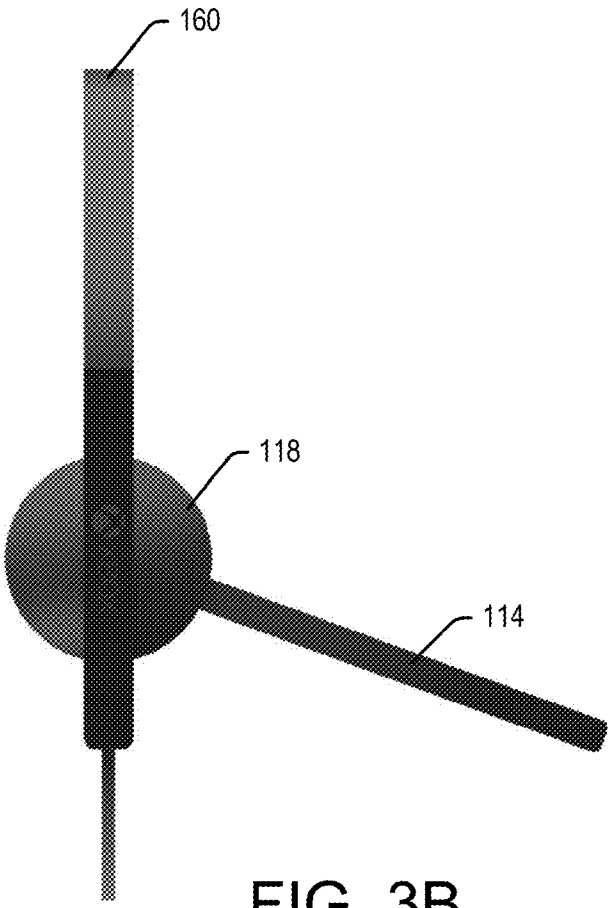
FIGS. 3A and 3B are front and side views of a headset according to embodiments of the present technology.
Figure 3A:
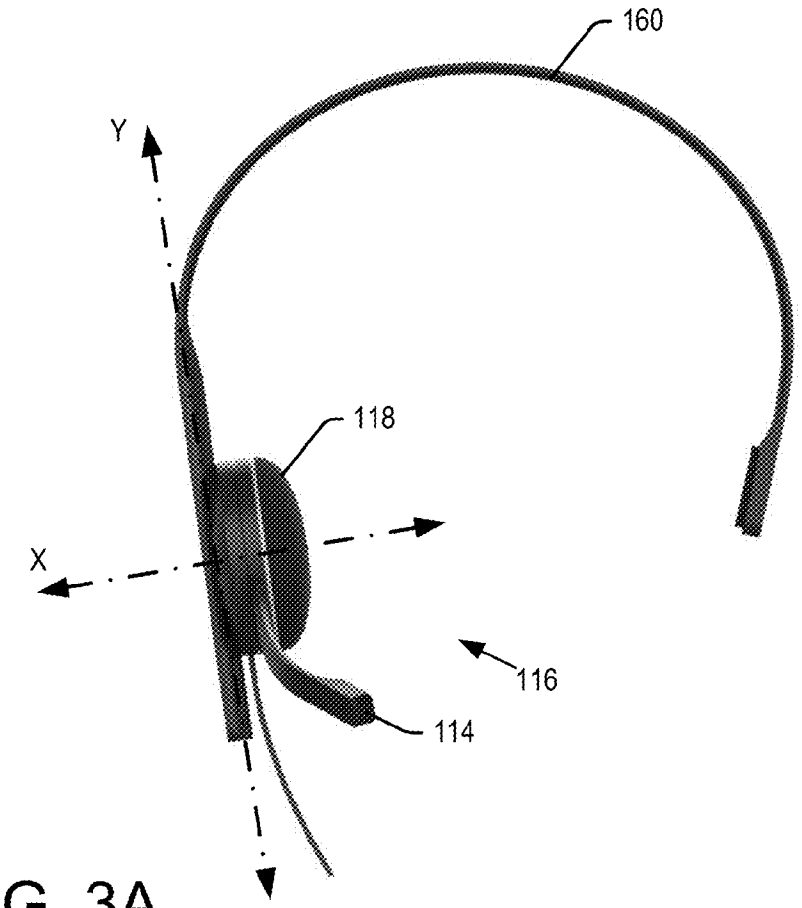
Figure 4A:
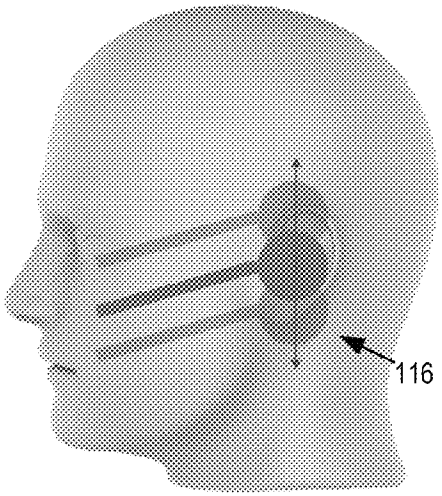
FIG. 4A illustrates translational adjustment of an audio assembly according to embodiments of the present technology.
Figure 4B:
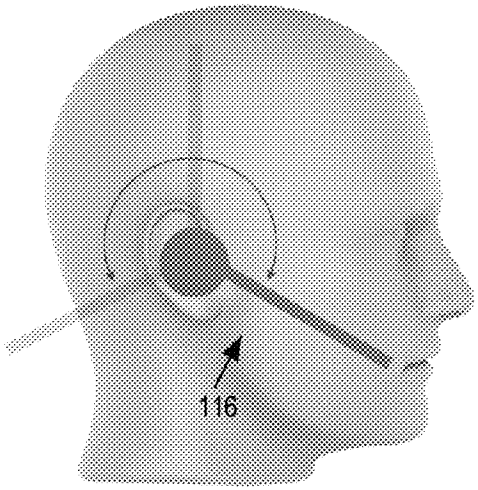
FIG. 4B illustrates rotational adjustment of an audio assembly about a first axis according to embodiments of the present technology.
Figure 4C:
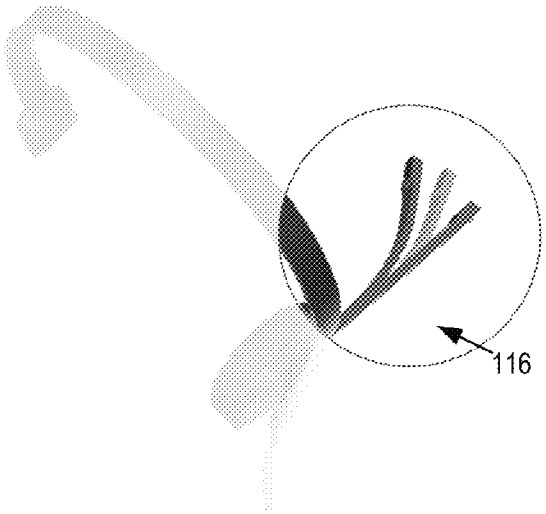
FIG. 4C illustrates adjustment of an audio assembly about a second axis in according to embodiments of the present technology.
Figure 5:
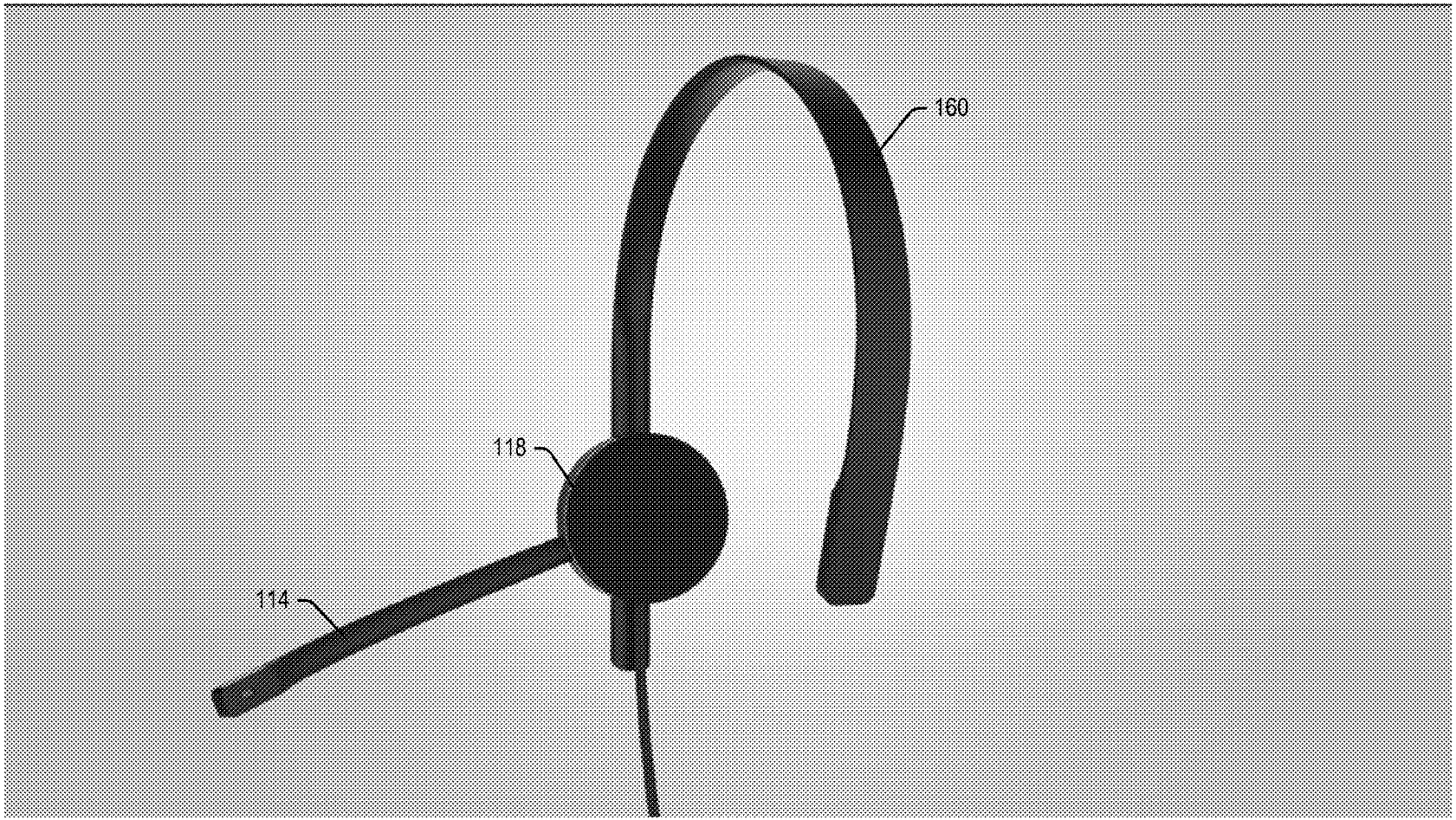
FIG. 5 is a perspective view of a headset according to embodiments of the present technology.
Figure 7:
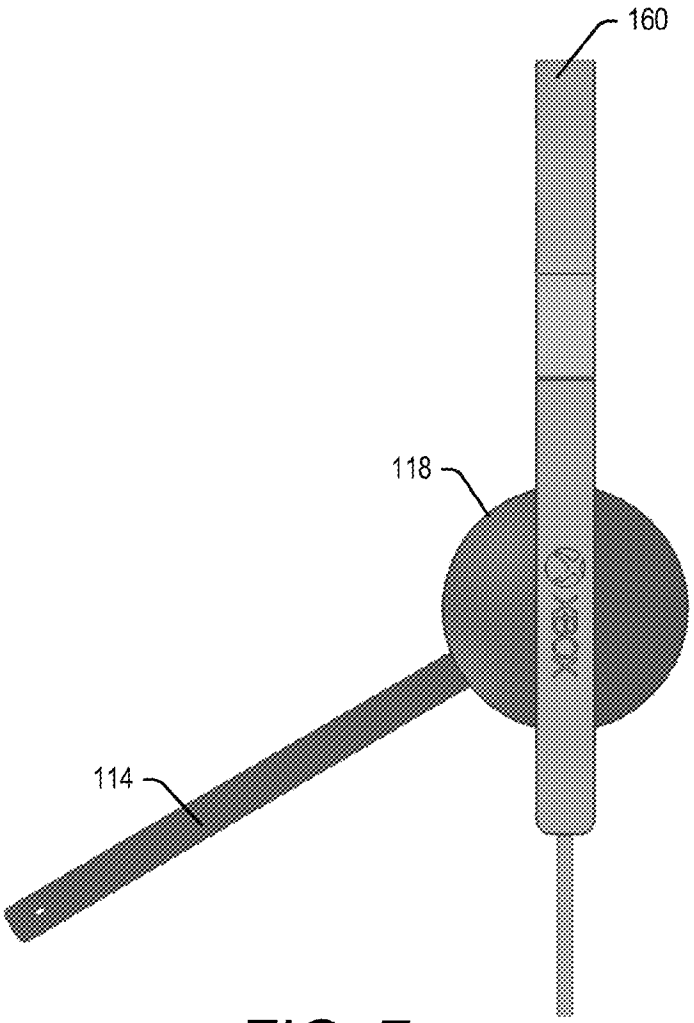
FIGS. 6 and 7 are front and side views of a headset according to embodiments of the present technology.
Figure 6:
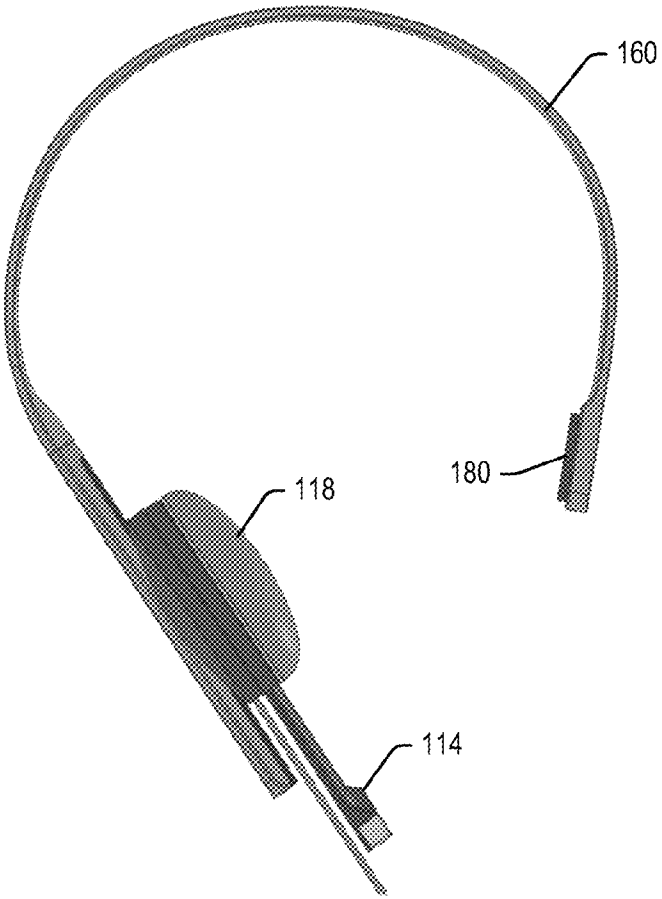
Figure 8:
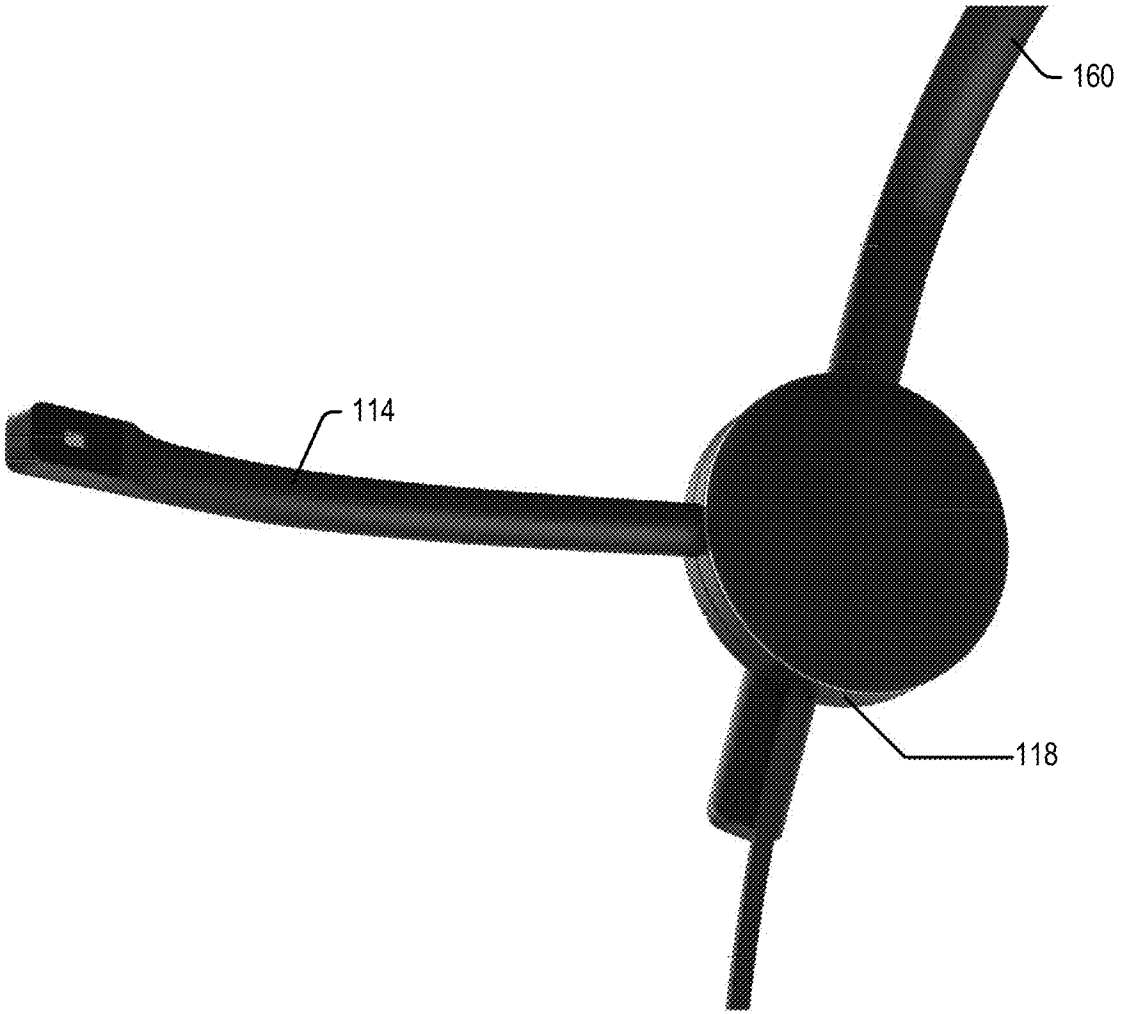
FIG. 8 is an enlarged perspective view of a portion of the headset according to embodiments of the present technology.
Figure 11:
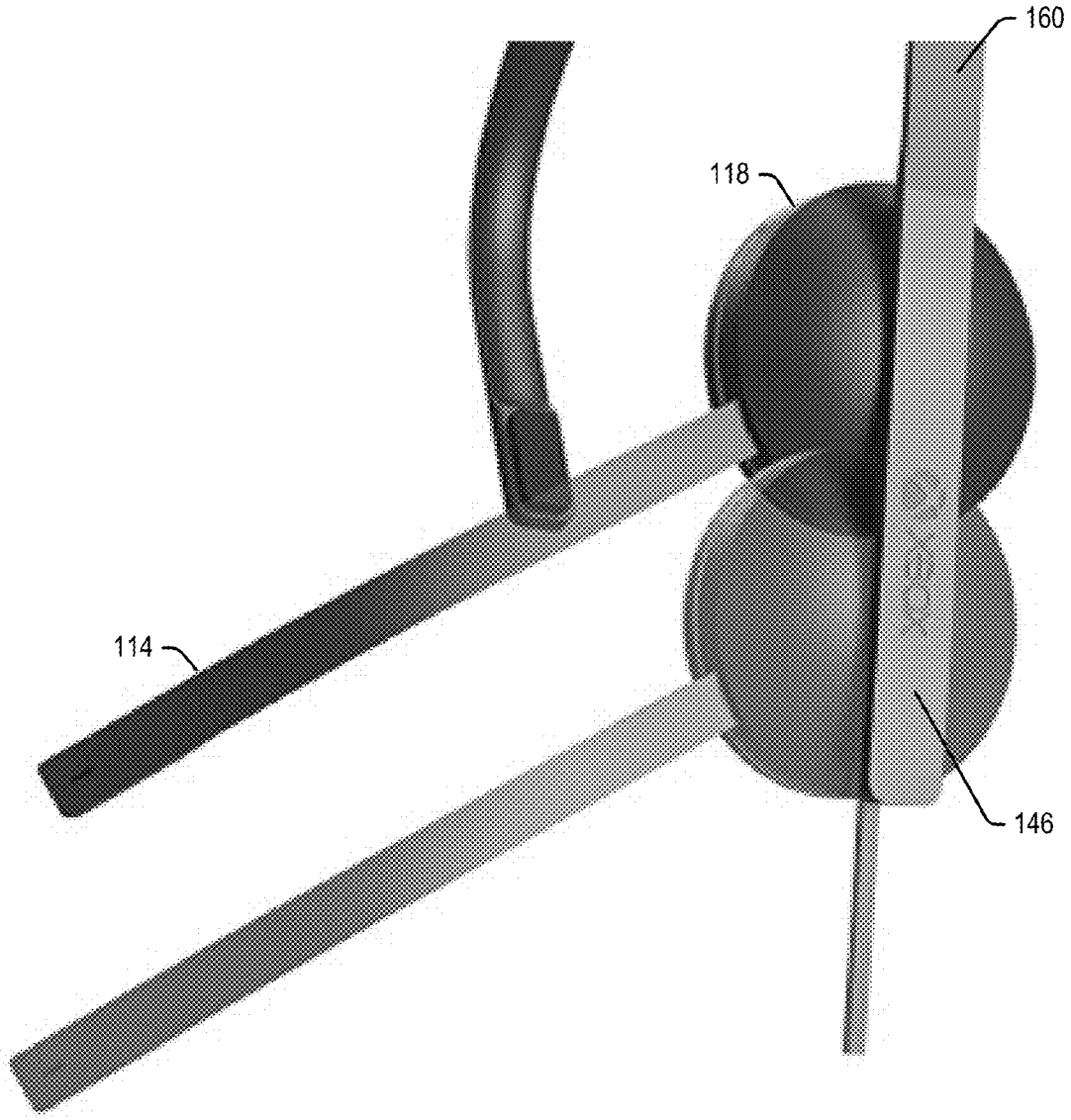
FIG. 11 illustrates translational adjustment of an audio assembly according to embodiments of the present technology.

FIGS. 3A and 3B illustrate headset 102, and orthogonal reference axes x and y about which an ear pod 118 and microphone 114 can translate and rotate. The ear pod 118 and microphone 114 may together be described herein as audio assembly 116. FIGS. 4A, 4B and 4C illustrate the headset 102 worn by a user, and illustrate various ways the audio assembly 116 may be adjusted. FIG. 4A illustrates how the audio assembly 116 may translate up and down along the y-axis. FIG. 11 also shows translation along the y-axis. In addition to translation about the y-axis, the audio assembly 116 is also mounted for rotation about the y-axis. This feature is described below with respect to FIGS. 12 and 13.

In addition to translation along and rotation about the y-axis, the audio assembly is also capable of rotation about the x-axis, orthogonal to the y-axis. FIG. 4B illustrates rotation about the x-axis, which is into and out of the page of FIG. 4B, perpendicular to a major planar surface taken for example through a circular cross-section of the ear pod 118. The mechanisms for slidably and rotationally mounting the audio assembly to the headband are explained below.

Figure 9A:
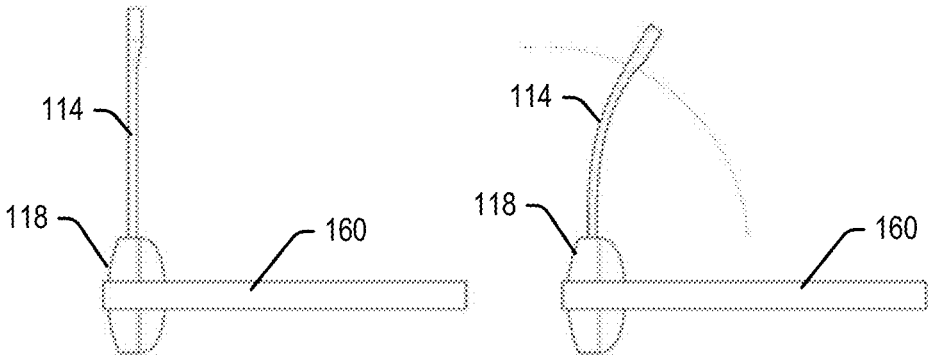
FIGS. 9A and 9B illustrate various rotations of a microphone boom relative to a headband of the headset according to embodiments of the present technology.
Figure 9B:
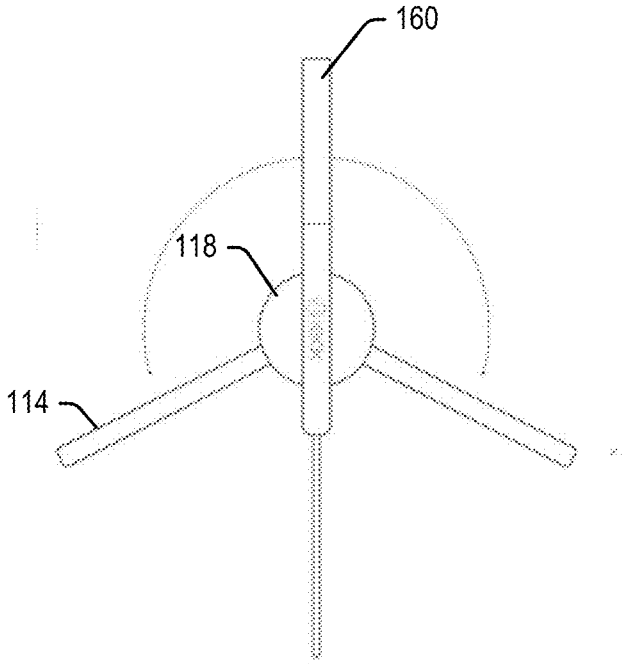
Figure 10:
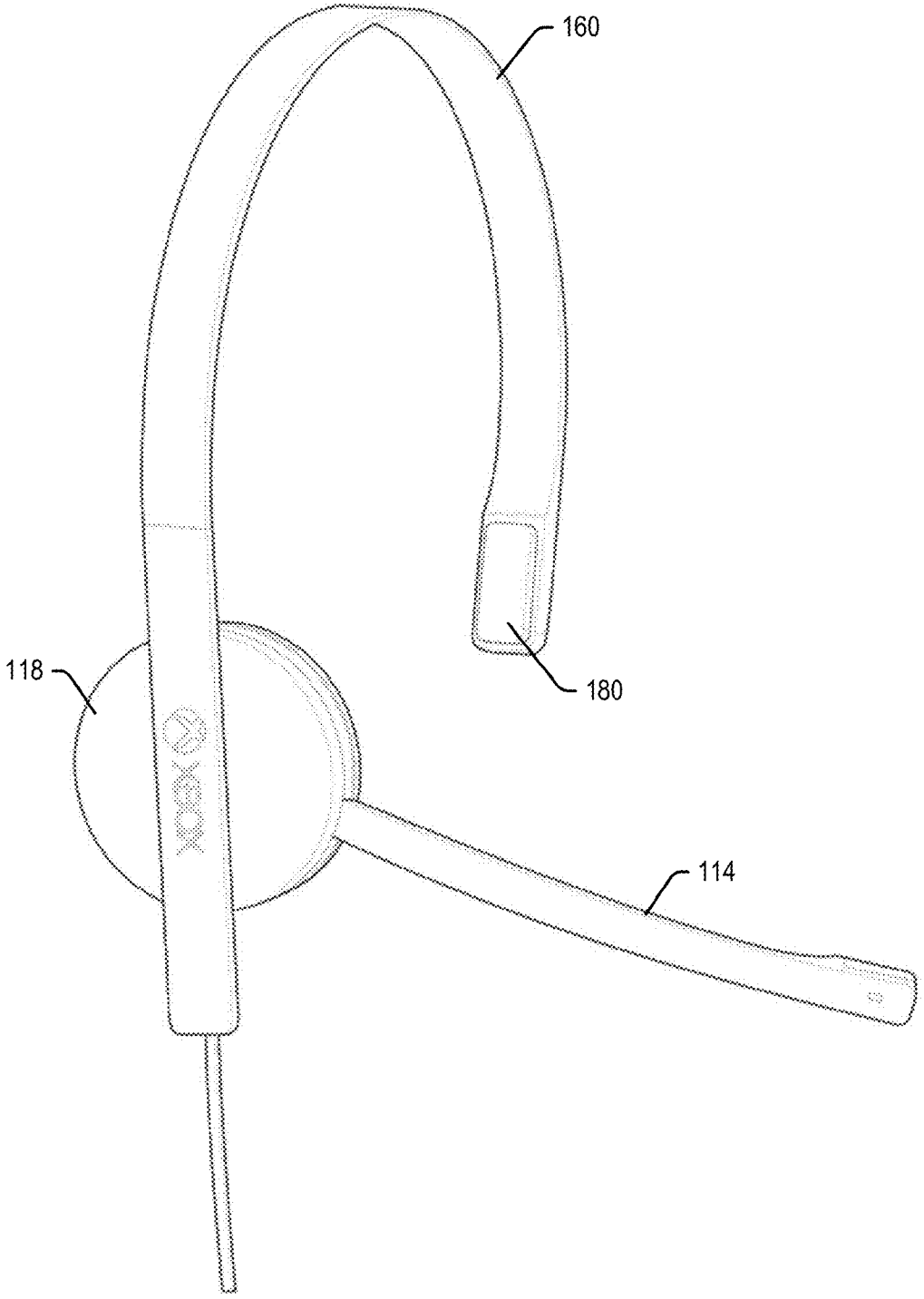
FIG. 10 is a further perspective view of a headset according to embodiments of the present technology.

In addition to translation along the y-axis, and rotation about the x- and y-axes, the microphone 114 may be mounted on a flexible boom 134 which may bend around the y-axis as well. This feature is shown in FIGS. 4C and 9A. This, the boom 134 may rotate about the y-axis to position a microphone assembly 150 nearer or farther from the mouth of a user. Additionally or alternatively, the boom may be flexible to bend the boom about the y-axis to position the microphone assembly 150 nearer or farther from the mount of a user.

The range of translation and rotation may vary in embodiments, but in one example, the audio assembly 116 may translate over a range of 40 mm along the y-axis, rotate over a range of 45° around the y-axis, and rotate over a range of 300° around the x-axis. It is understood that these ranges are provided by way of example only and the degree of translation and/or rotations may be of above or below these ranges in further embodiments.

FIGS. 5-11 illustrate the ear pod 118 and microphone 114 of the audio assembly 116 mounted to the headband 160. The headband 160 may be formed of plastic or other flexible, shape-memory material. The headband 160 may include a foam temple pad 180 at an end of the headband 160 opposite to that including the ear pod 118. The temple pad 180 is provided to increase comfort and support of the headband 160 on a user's head.

Figure 12:
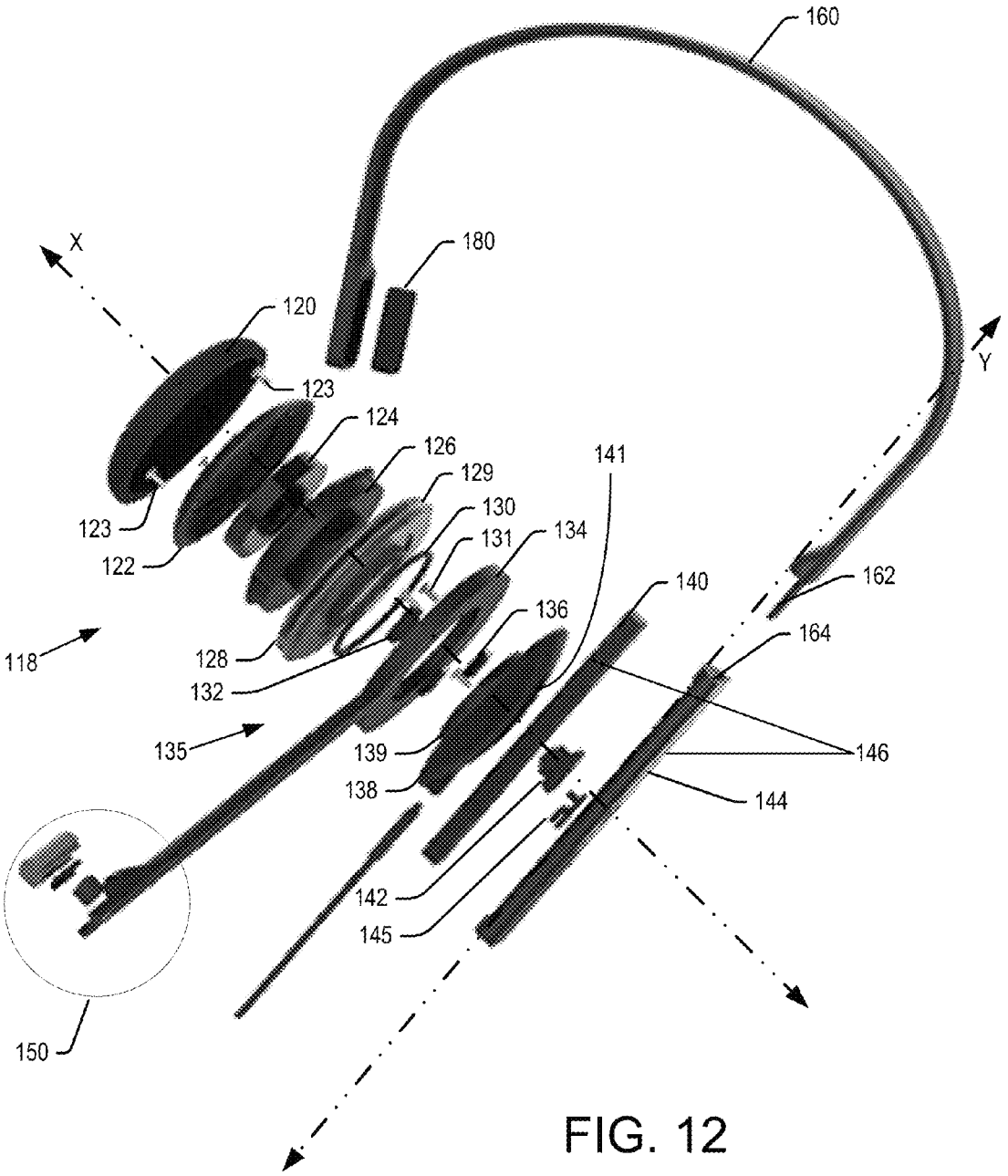
FIG. 12 is an exploded perspective view of a headset according to embodiments of the present technology.

As noted, the audio assembly 116 is mounted to the headband 160 so as to translate along the headband, and to rotate about multiple axes of the headband. The mechanisms for affixing the audio assembly 116 to the headband 160 to move in this manner will now be explained with reference to FIG. 12. FIG. 12 is an exploded perspective view of the audio assembly 116 of headset 102. The headset includes an ear pod 118 having a foam ear pad 120 that lies against a user's ear. Interior of that is an ear pod front cover 122. As explained below, screws 123 fit through holes in the ear pod front cover 122 and mate within an ear pod back cover 138 to secure and enclose the contents of the ear pod 118.

Inside the ear pod front cover is a speaker assembly including a speaker 124 and an acoustic back-chamber 126 for providing a resonance cavity for the speaker. Inward of the speaker assembly is a hub 128 including a groove 129. The ear pad 120 includes a lip (not labeled) which stretches around the outer diameter of the hub 128 and is held within groove 129 to maintain the ear pad 120 in the ear pod 118.

Inward of the hub 128 is an o-ring 130 and a microphone boom 134. The boom 134 supports a microphone assembly 150, and in embodiments may be 4.5 inches long. It may be other lengths in further embodiments. The microphone boom 134 may have a circular base and may be coaxial with the ear pod 118. As described above, the microphone boom 134 and microphone assembly 150 may rotate around the x-axis, relative to the ear pod. The o-ring 130 provides a degree of resistance and static friction to hold the boom 134 in place, absent an external biasing force, once the boom is rotated to the desired position.

The ear pod 118 further includes a rotation/translation assembly 135 including slide bases 132 and 136, slide 142 and ratchet 145. When the ear pod is assembled, the components 132, 136, 142 and 145 of the rotation/translation assembly 135 at least partially reside within a slider housing 146 including covers 140 and 144. The components 132, 136, 142 and 145 support the ear pod 118 within the slider housing 146. In particular, the slide 142 slides within a slot (not shown) in the slider cover 140 so that the ear pod 118 can translate along the y-axis of the slide cover 140, and rotate within the slider cover 140 around the y-axis. The operation of these components is explained below.

Figure 13:
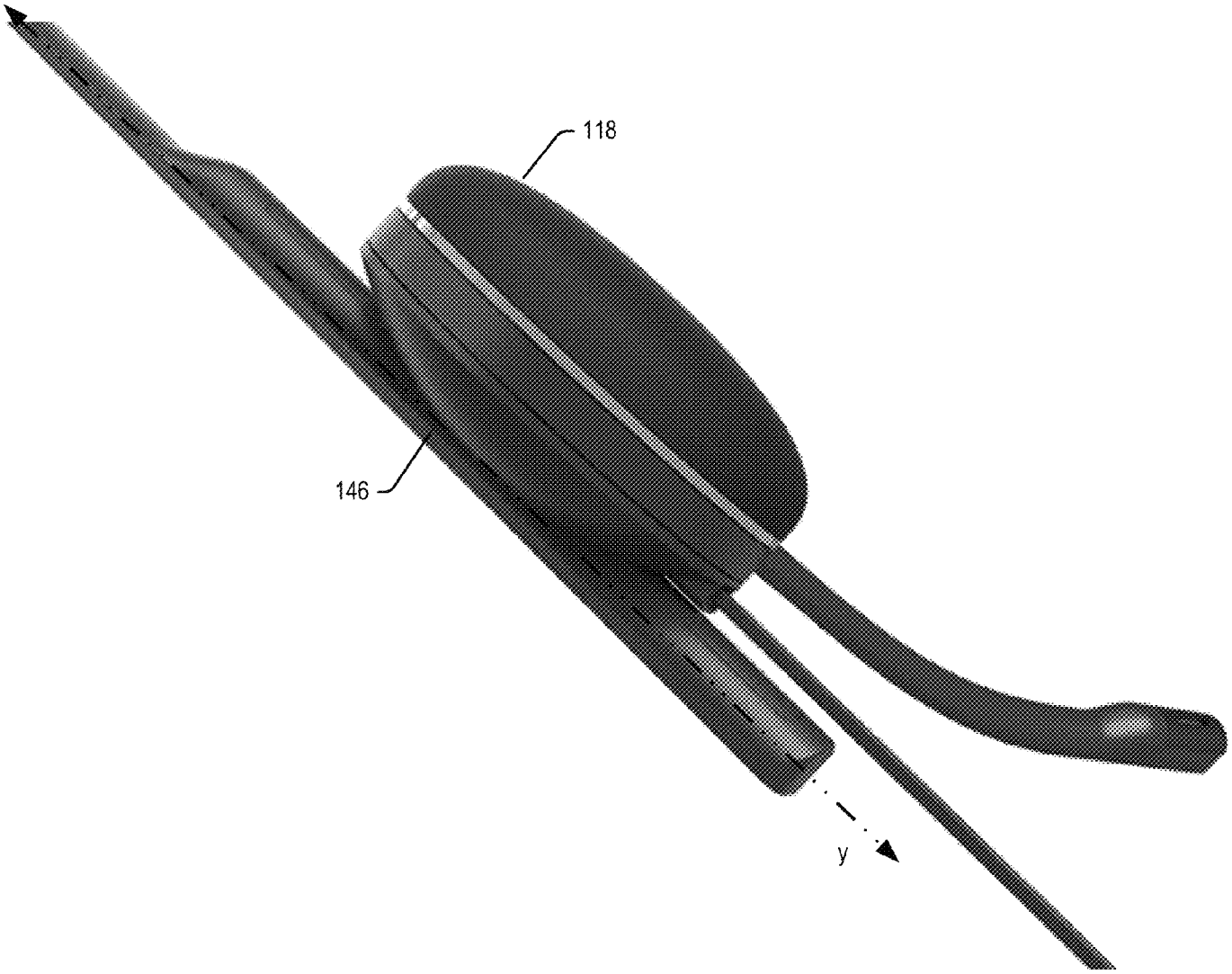
FIG. 13 is an enlarged perspective view of a portion of the headset according to embodiments of the present technology.

Ear pod back cover 138 serves multiple functions. As noted above, the ear pod back cover receives screws 123 to secure and enclose the contents of the ear pod 118 together with the ear pod front cover 122. Back cover 138 also includes a first surface having a boss 139. The boss 139 has a diameter sized to rotatably support the boom 134 thereon. The back cover 138 further includes an opening within which cord 106 is received. Additionally, the back cover 138 includes a second surface, opposite the first surface, including a groove 141. The slider housing 146 is received in the groove 141 as seen in FIGS. 12 and 13 in a way that allows the back cover 138 and the rest of the ear pod 118 to translate along the slider housing 146 and rotate about the slider housing 146.

In particular, the slider housing 146 includes the slider cover 140 that mates with the logo cover 144. When affixed together, a cavity (not shown) is defined within the covers 140, 144. Slide 142 of the rotation/translation assembly 135 rides within the cavity. A portion of slide 142 extends through a slot (not shown) formed in a surface of the slider cover 140. The slot extends along the length of slider cover 140, and the length of the slot in part defines the range over which the ear pod 118 may translate along the slider housing 146.

A portion of the slide 142 extends through the slot, and snugly into an opening (not shown) in the groove 141 of back cover 138. The slide 142 mounts to slide bases 132, 136 via screws 137. By this arrangement, the slide 142 connects the ear pod 118 to the slider housing 146 (with the housing 146 positioned with the groove 141 of the back cover 138). The slide 142 is secured to and moves with the ear pod 118 as the ear pod translates along the slot in the slider cover 140.

The slide 142 fits snuggly within the cavity in the slider housing 146. The groove 141 may also fit snugly around the slider housing 146. One or both of these engagements provide frictional resistance to translation of the slide 142 and ear pod 118 along the slider housing. Thus, once adjusted by a user to a desired position along the y-axis, the slide 142 and ear pod 118 stay in that position. Additionally, the slide 142 engages the ratchet 145, which rides within a track (not shown) in the logo cover 144. The track provides discrete stopping positions for the ratchet 145, slide 142 and ear pod 118 along the slot in the slider cover 140. These discrete stopping positions hold the ratchet 145, slide 142 and ear pod 118 in position when unbiased, but may be overcome by the force of a user moving the ear pod 118 along the slider housing 146.

Figure 14:
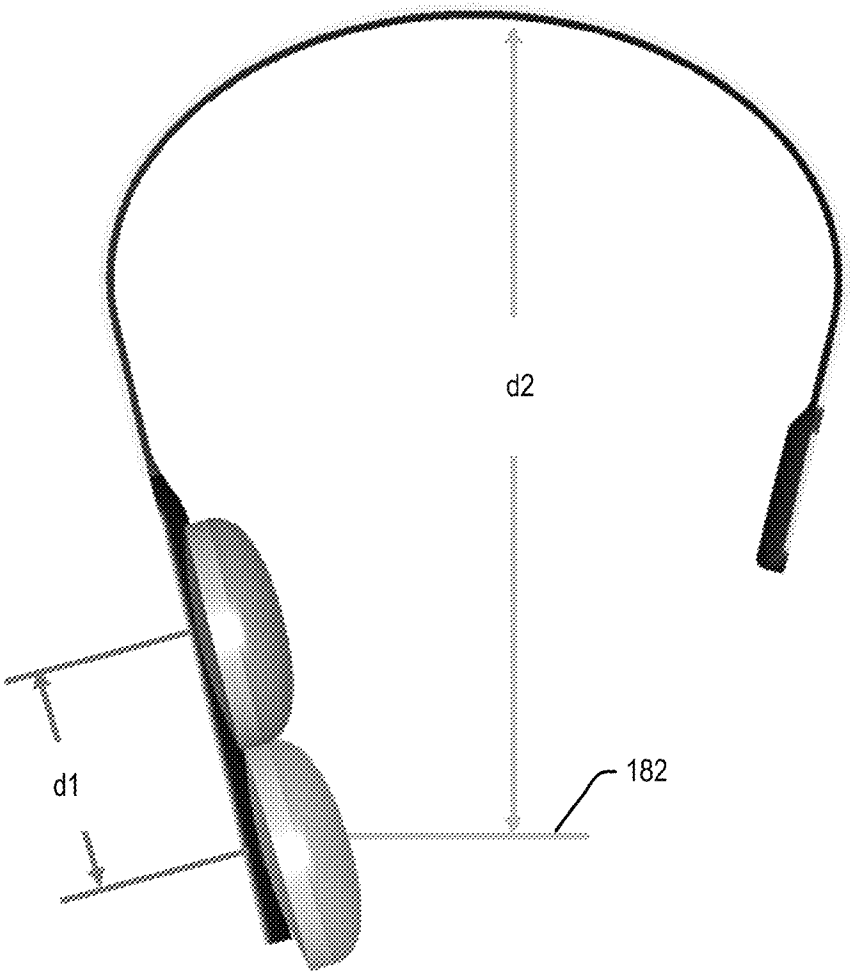
FIG. 14 is a front view of the head set illustrating translational adjustment of an ear pod according to embodiments of the present technology.

FIGS. 11 and 14 illustrates the ear pod 118 in two different positions along the slider housing 146. In embodiments, the ear pod 118 may move over a distance, d1, of 40 mm within the slot of the slider housing 146. In an example, when fully extended in a lowermost position, the distance, d2, from a crown of the headband 160 to a centerline 182 of the ear pod 118 may be 155 mm. It is understood that these dimensions may each vary in further embodiments.

The slide 142 is further engaged in the slot in the slider cover 140 in a way that allows the slide 142 and ear pod 118 to rotate over a predefined range around the slider housing 146 and the y-axis. Again, the frictional fit of the slide 142 in the slider housing cavity, and/or the frictional fit of the slider housing 146 in the groove 141, maintain the ear pod at a given angle around the y-axis once rotated and released by a user.

Figure 15:
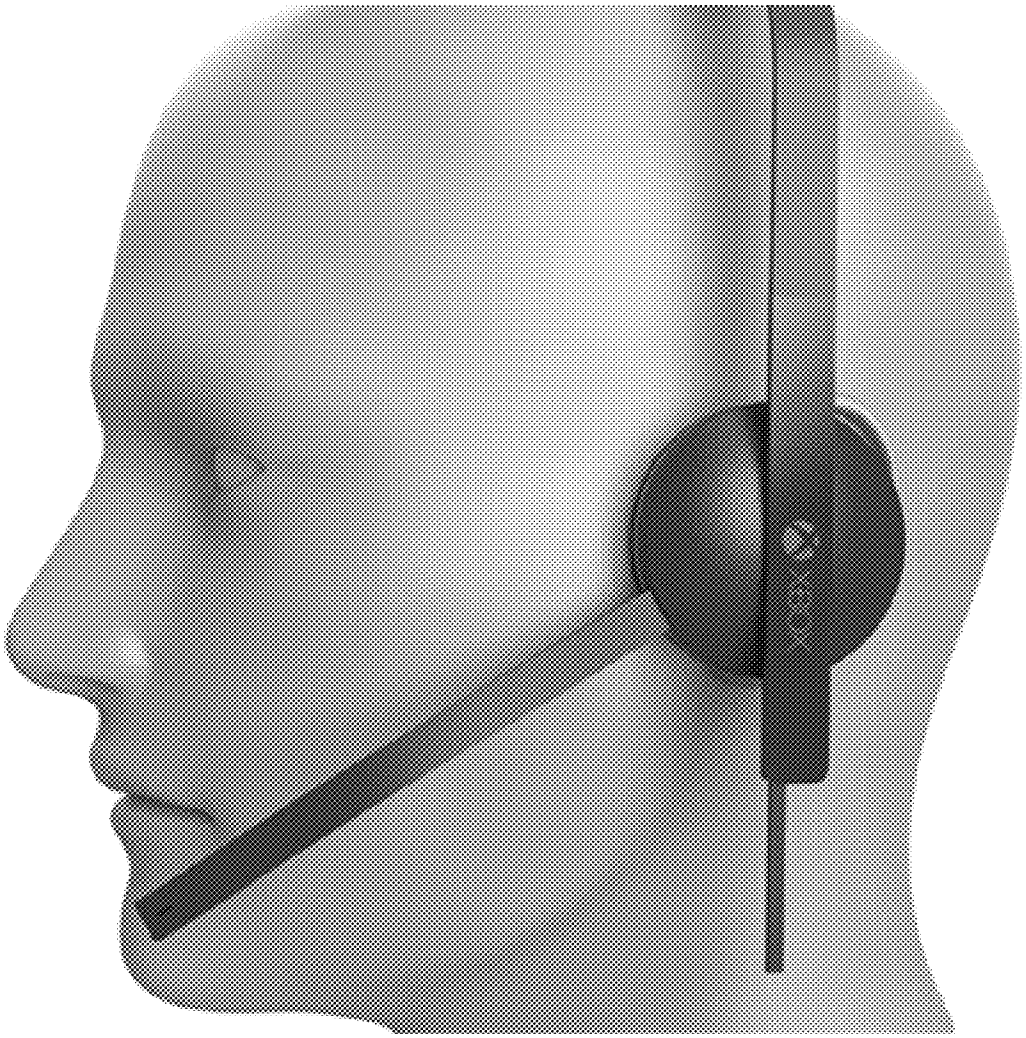
FIG. 15 is a side view of a headset worn by a user according to embodiments of the present technology.
Figure 16:
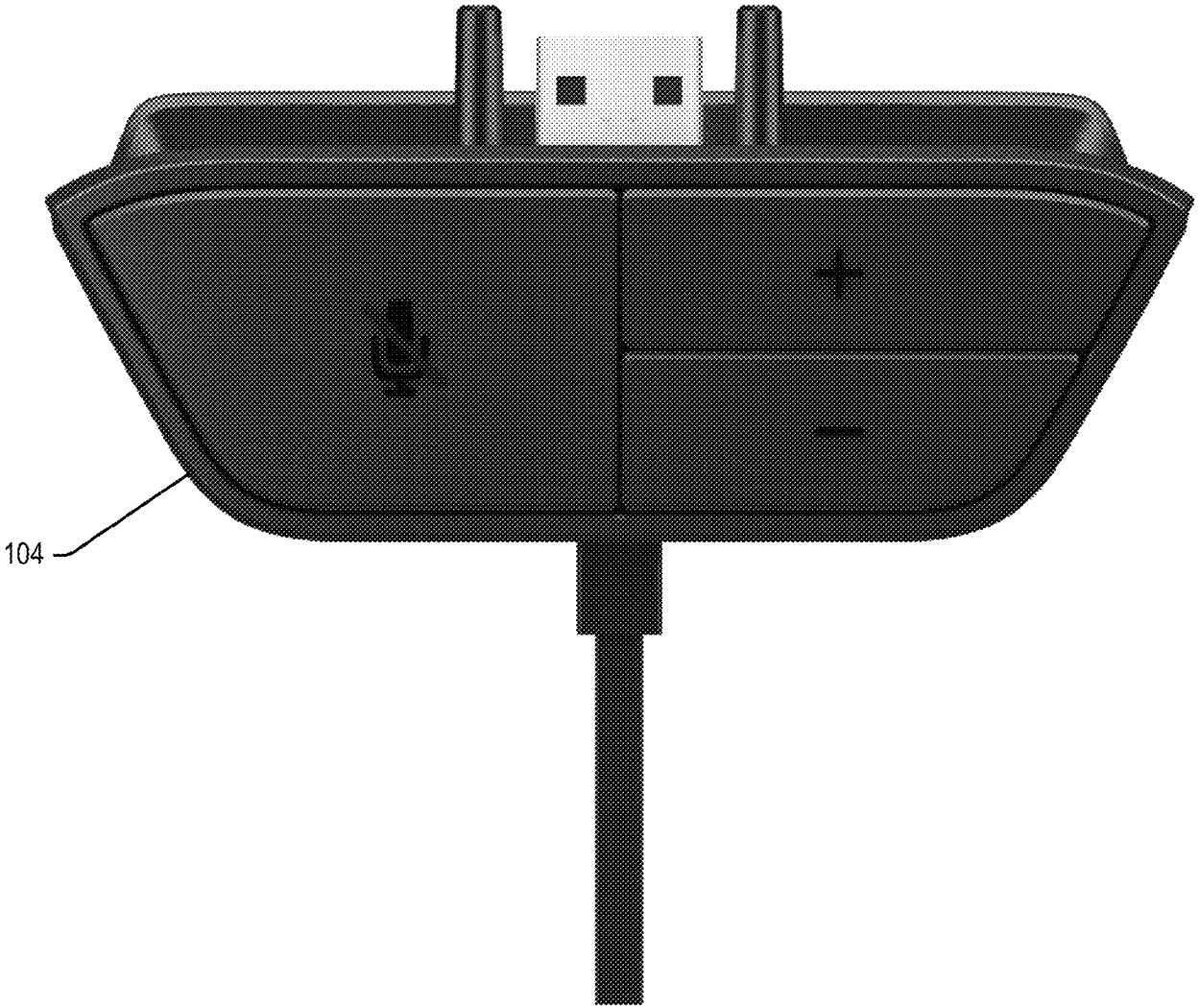
FIG. 16 is a front perspective view of a volume controller according to embodiments of the present technology.

The slider housing 146 is affixed to a portion of the headband 160 by a tab 162 which fits in an opening 164 in the top of the slider housing 146. FIG. 15 shows the ear pod 118 affixed to the slider housing 146 and headband 160 on the head of a user.

Figure 18:
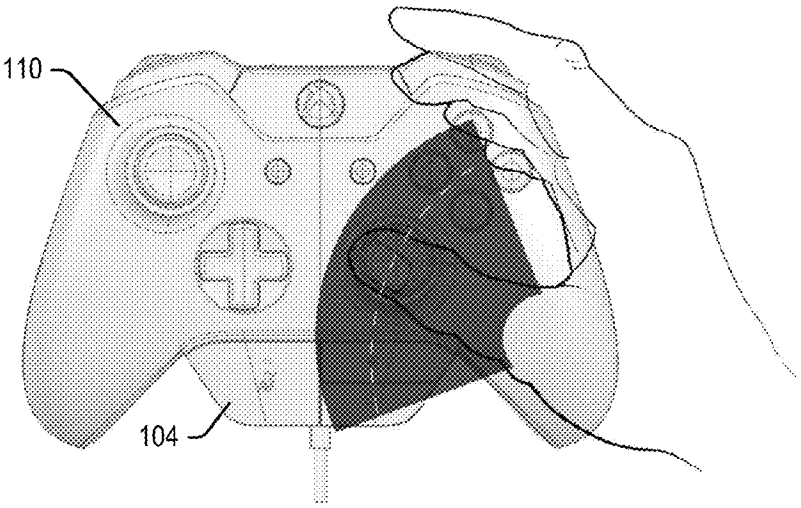
FIGS. 17 and 18 illustrate actuation of a volume controller affixed to a game controller by a user according to embodiments of the present technology.
Figure 17:
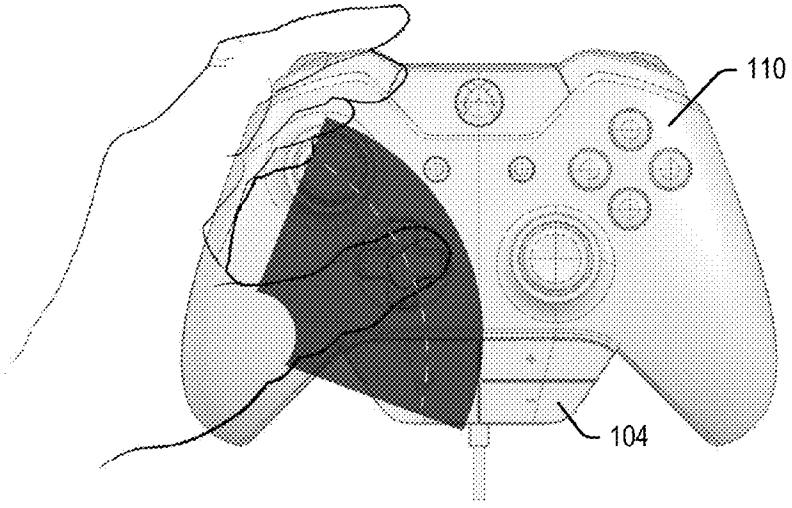
Figure 19:
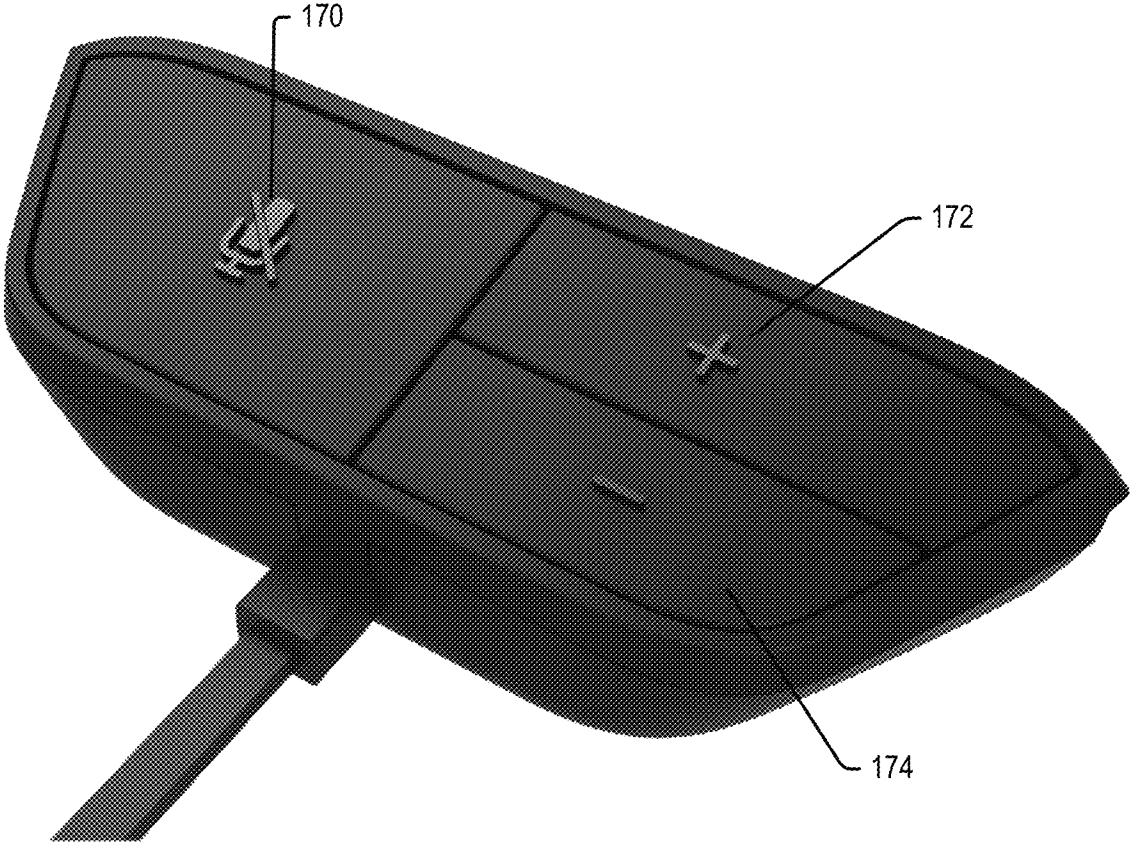
FIGS. 19 and 20 are further perspective views of a volume controller according to embodiments of the present technology.
Figure 20:
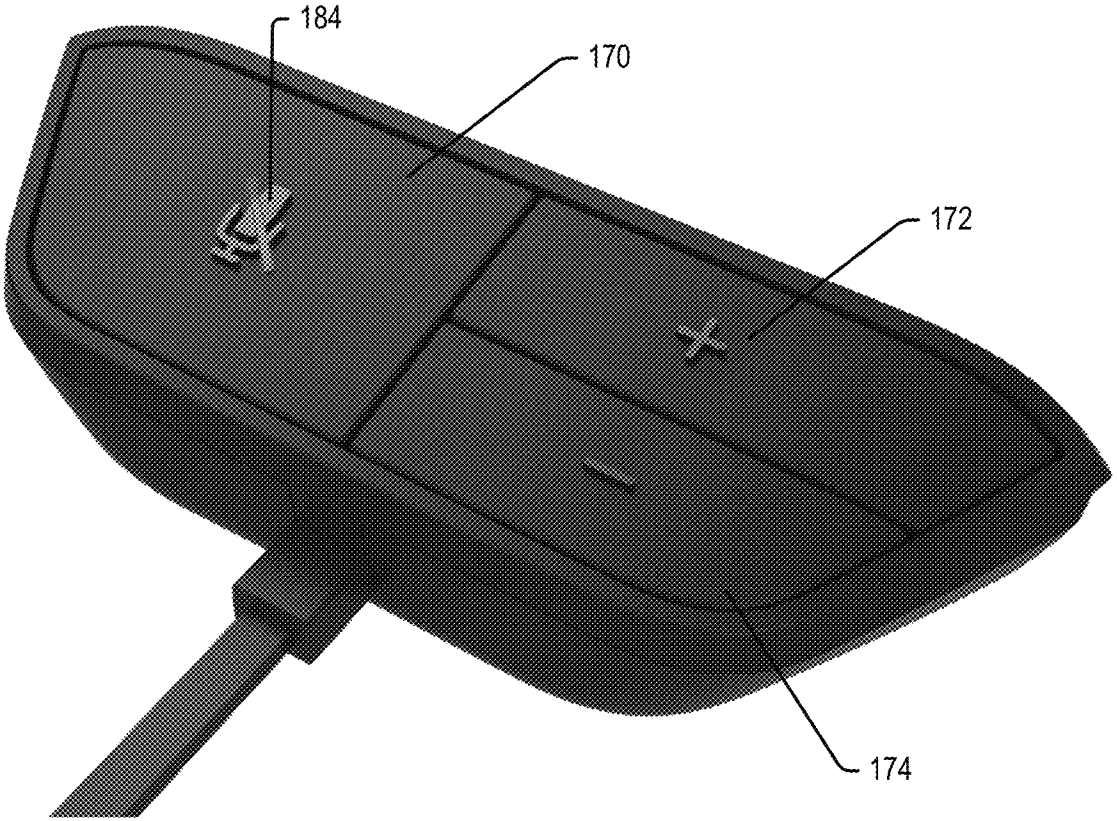
Figure 21:
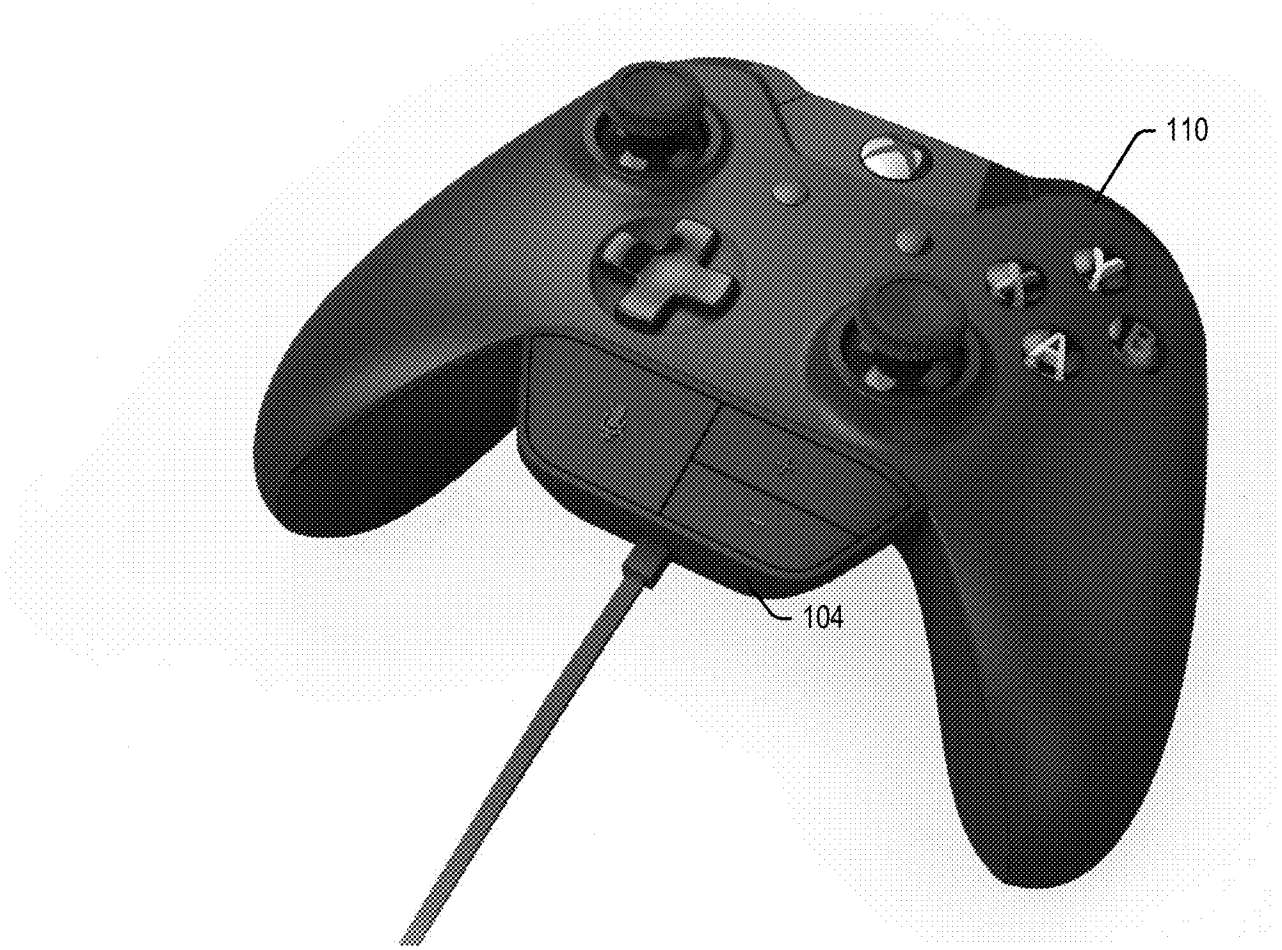
FIG. 21 is a perspective view of a violent controller affixed to a game controller according to embodiments of the present technology.
Figure 22:
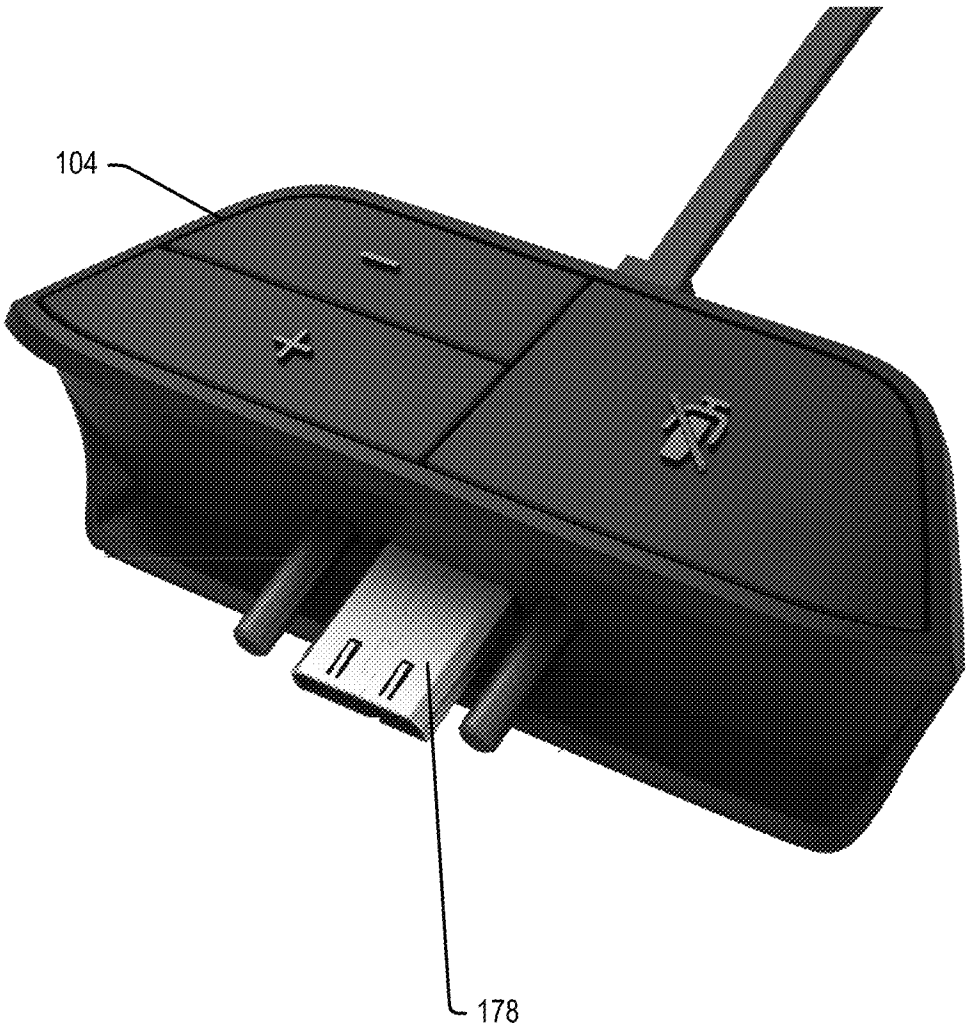
FIG. 22 is a rear perspective view of a volume controller according to embodiments of the present technology.

FIGS. 16-26 illustrate the volume controller 104, with some figures including text regarding additional features of the volume controller 104. As shown in FIGS. 17, 18 and 21, the volume controller may be mounted to a game controller 110 in such a way as to be easily actuated and operated by the left and/or right thumbs of a user. As shown for example in FIG. 19, the volume controller may include a mute button 170, a volume up button 172 and a volume down button 174. The mute button 170 may be easily actuated with a thumb of the user's left hand, and the volume up and volume down buttons 172, 174 may be easily actuated with a thumb of the user's right hand. The volume controller 104 may be mounted to and electrically coupled with the game controller 110 via a connector 178 (FIG. 22).

Figure 23:
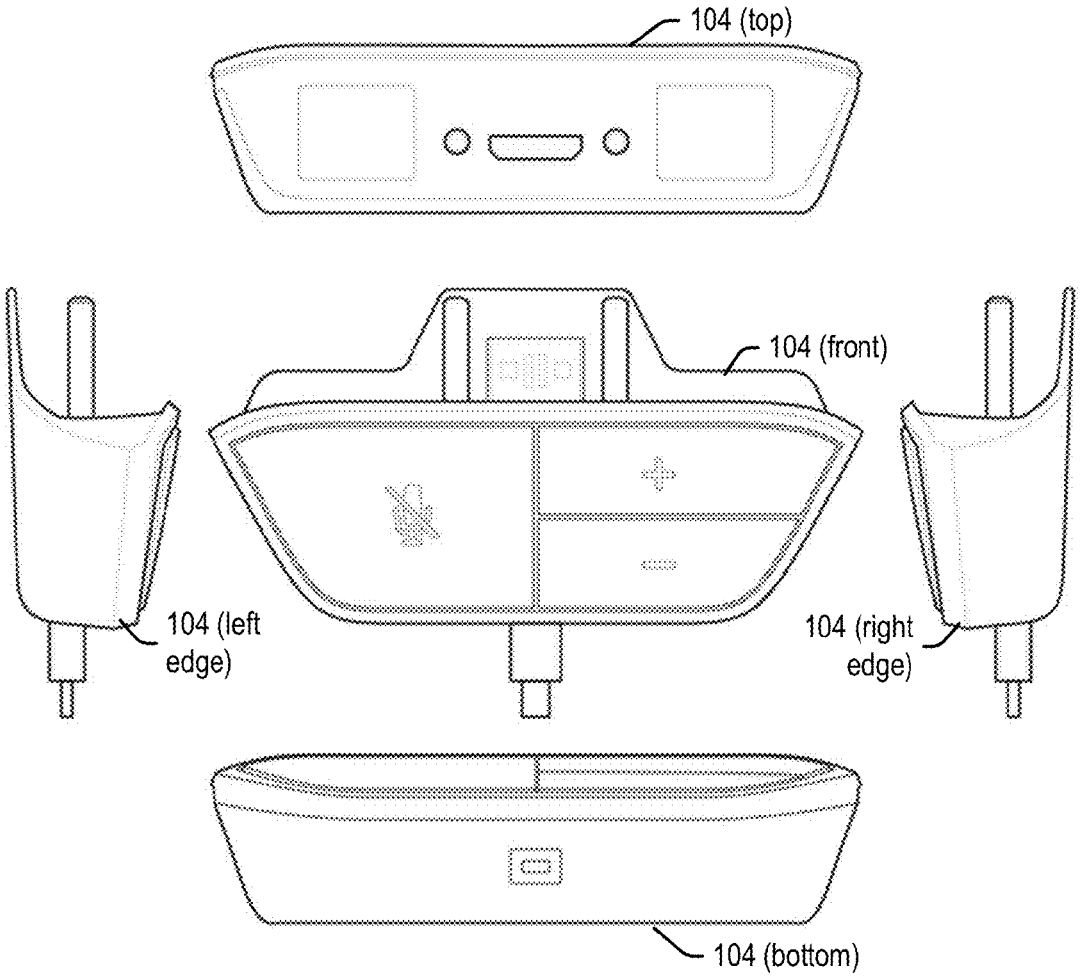
FIG. 23 shows various views of a violent controller according to embodiments of the present technology.
Figure 24:
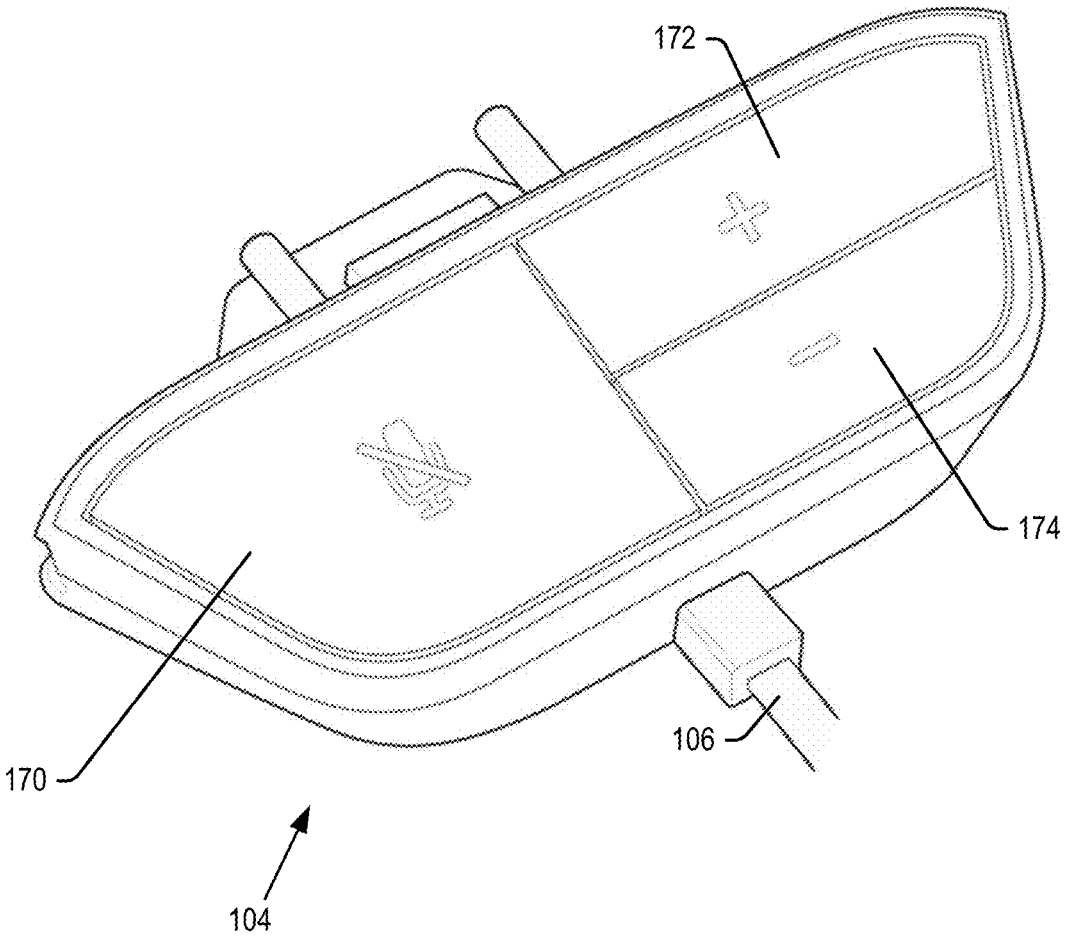
FIG. 24 is a further perspective view of a volume controller according to embodiments of the present technology.

The mute button 170 may mute the microphone 114 of the headset 102 when actuated. When actuated, an LED within the button 170 may illuminate a slash though a raised icon 184 of the microphone on button 170 to indicate that the microphone is muted (FIG. 20). The volume up and volume down buttons 172, 174 may be actuated to raise and lower the volume of sound to the ear pod 118. FIG. 23 shows the volume controller 104 from different perspectives as indicated. As discussed above and shown partially in FIG. 24, the volume controller may be affixed to the headset 102 via a cord 106. It is conceivable that the headset 102 attach via any of various short range wireless protocols to the volume controller 104 and/or game controller 110 in further embodiments. Such short range wireless protocols may include the Bluetooth® wireless protocol and infrared communications.

Figure 25:
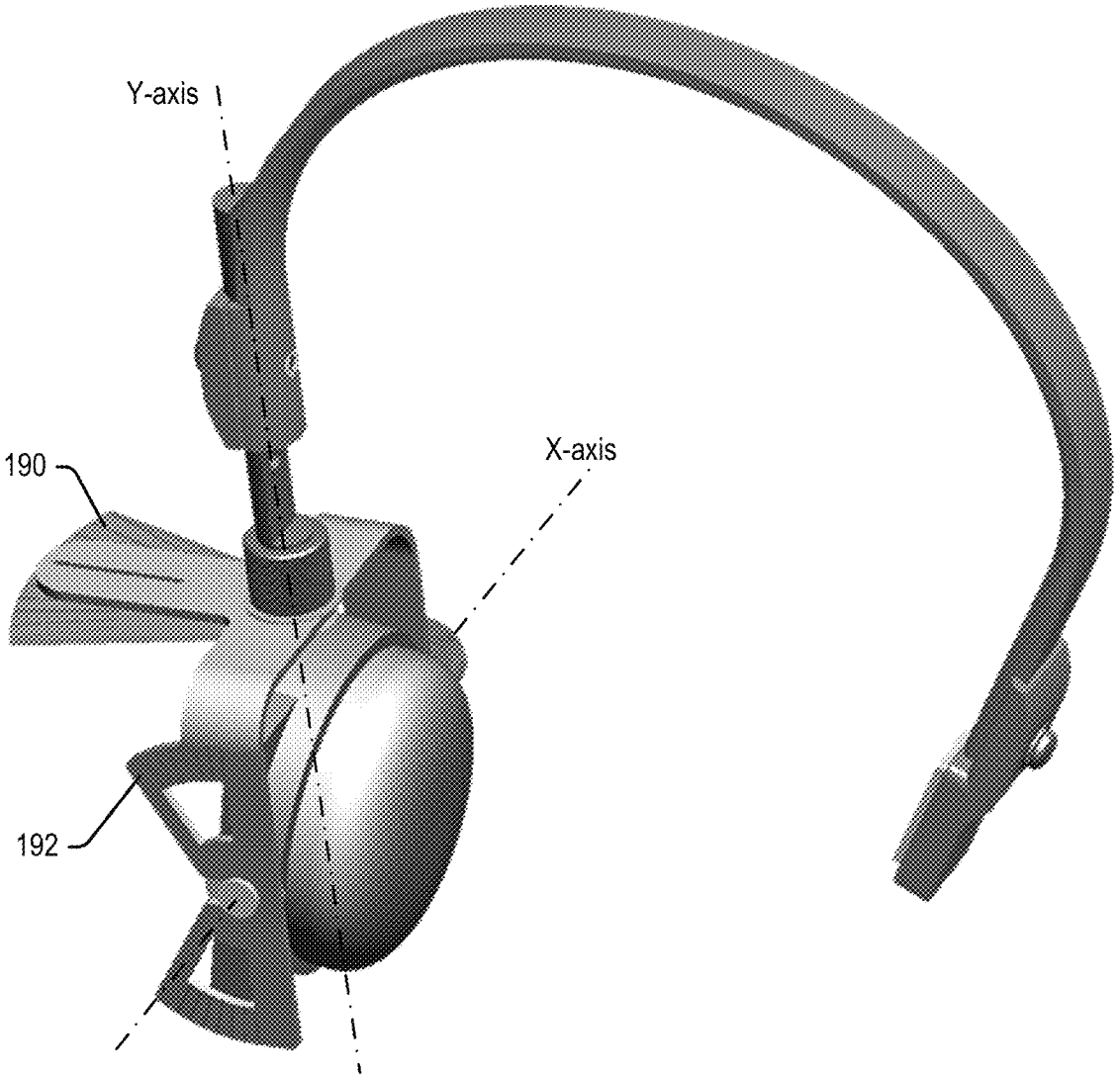
FIG. 25 is a headset according to alternative embodiment of the present technology.

FIG. 25 shows an alternative embodiment of a headset 102 where the ear pod 118 is supported for translation along the y-axis, rotation about the y-axis and rotation about the x-axis. The ear pod 118 may adjust along the y-axis for example 40 mm as described above. The ear pod 118 may rotate around the x-axis over a roll angle of for example +/−25°. The ear pod 118 may rotate around the y-axis over a yaw angle of for example +/−25°. This embodiment may include a yaw angle indicator 190 to indicate the yaw angle, and a roll angle indicator 192 to indicate the roll angle. A further indicator (not shown) may indicate the amount of translation along the y-axis. Although not shown, the embodiment of FIG. 25 may include a microphone 114 as described above.

Figure 26:
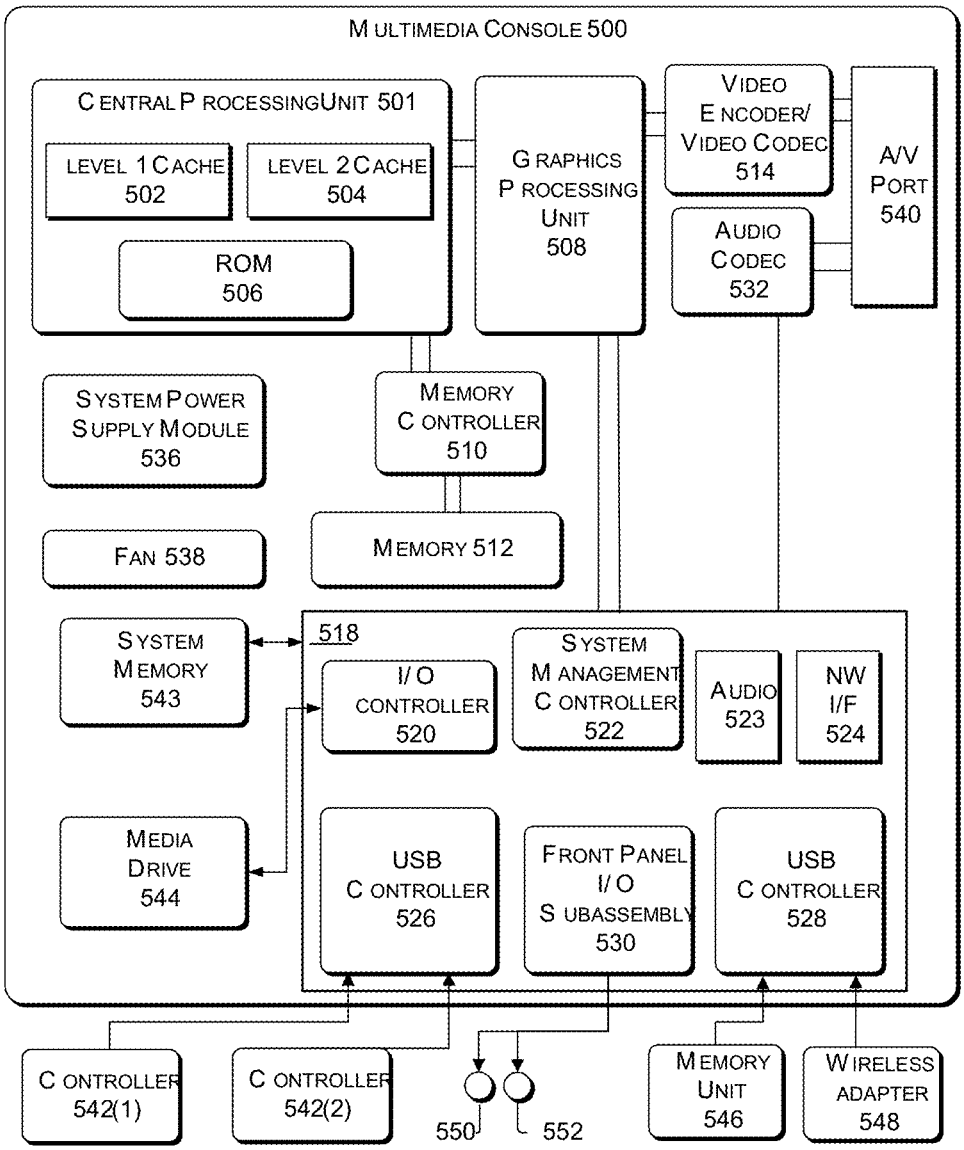
FIG. 26 is a block diagram depicting the components of an example entertainment console with which the headset assembly of the present technology may be used.

As noted, the headset assembly 100 may be used with a computing system such as a gaming console. FIG. 26 illustrates an example embodiment of a computing system that may be used to implement hub computing system 12. As shown in FIG. 26, the multimedia console 500 has a central processing unit (CPU) 501 having a level 1 cache 502, a level 2 cache 504, and a flash ROM (Read Only Memory) 506. The level 1 cache 502 and a level 2 cache 504 temporarily store data and hence reduce the number of memory access cycles, thereby improving processing speed and throughput. CPU 501 may be provided having more than one core, and thus, additional level 1 and level 2 caches 502 and 504. The flash ROM 506 may store executable code that is loaded during an initial phase of a boot process when the multimedia console 500 is powered on.

A graphics processing unit (GPU) 508 and a video encoder/video codec (coder/decoder) 514 form a video processing pipeline for high speed and high resolution graphics processing. Data is carried from the graphics processing unit 508 to the video encoder/video codec 514 via a bus. The video processing pipeline outputs data to an A/V (audio/video) port 540 for transmission to a television or other display. A memory controller 510 is connected to the GPU 508 to facilitate processor access to various types of memory 512, such as, but not limited to, a RAM (Random Access Memory).

The multimedia console 500 includes an I/O controller 520, a system management controller 522, an audio processing unit 523, a network interface 524, a first USB host controller 526, a second USB controller 528 and a front panel I/O subassembly 530 that are preferably implemented on a module 518. The USB controllers 526 and 528 serve as hosts for peripheral controllers 542(1)-542(2), a wireless adapter 548, and an external memory device 546 (e.g., flash memory, external CD/DVD ROM drive, removable media, etc.). The network interface 524 and/or wireless adapter 548 provide access to a network (e.g., the Internet, home network, etc.) and may be any of a wide variety of various wired or wireless adapter components including an Ethernet card, a modem, a Bluetooth module, a cable modem, and the like.

System memory 543 is provided to store application data that is loaded during the boot process. A media drive 544 is provided and may comprise a DVD/CD drive, Blu-Ray drive, hard disk drive, or other removable media drive, etc. The media drive 544 may be internal or external to the multimedia console 500. Application data may be accessed via the media drive 544 for execution, playback, etc. by the multimedia console 500. The media drive 544 is connected to the I/O controller 520 via a bus, such as a Serial ATA bus or other high speed connection (e.g., IEEE 1394).

The system management controller 522 provides a variety of service functions related to assuring availability of the multimedia console 500. The audio processing unit 523 and an audio codec 532 form a corresponding audio processing pipeline with high fidelity and stereo processing. Audio data is carried between the audio processing unit 523 and the audio codec 532 via a communication link. The audio processing pipeline outputs data to the A/V port 540 for reproduction by an external audio user or device having audio capabilities.

The front panel I/O subassembly 530 supports the functionality of the power button 550 and the eject button 552, as well as any LEDs (light emitting diodes) or other indicators exposed on the outer surface of the multimedia console 500. A system power supply module 536 provides power to the components of the multimedia console 500. A fan 538 cools the circuitry within the multimedia console 500.

The CPU 501, GPU 508, memory controller 510, and various other components within the multimedia console 500 are interconnected via one or more buses, including serial and parallel buses, a memory bus, a peripheral bus, and a processor or local bus using any of a variety of bus architectures. By way of example, such architectures can include a Peripheral Component Interconnects (PCI) bus, PCI-Express bus, etc.

When the multimedia console 500 is powered on, application data may be loaded from the system memory 543 into memory 512 and/or caches 502, 504 and executed on the CPU 501. The application may present a graphical user interface that provides a consistent user experience when navigating to different media types available on the multimedia console 500. In operation, applications and/or other media contained within the media drive 544 may be launched or played from the media drive 544 to provide additional functionalities to the multimedia console 500.

The multimedia console 500 may be operated as a standalone system by simply connecting the system to a television or other display. In this standalone mode, the multimedia console 500 allows one or more users to interact with the system, watch movies, or listen to music. However, with the integration of broadband connectivity made available through the network interface 524 or the wireless adapter 548, the multimedia console 500 may further be operated as a participant in a larger network community. Additionally, multimedia console 500 can communicate with processing unit 4 via wireless adaptor 548.

Optional input devices (e.g., controllers 542(1) and 542(2)) are shared by gaming applications and system applications. The input devices are not reserved resources, but are to be switched between system applications and the gaming application such that each will have a focus of the device. The application manager preferably controls the switching of input stream, without knowing the gaming application's knowledge and a driver maintains state information regarding focus switches. Capture device 20 may define additional input devices for the console 500 via USB controller 526 or other interface. In other embodiments, hub computing system 12 can be implemented using other hardware architectures. No one hardware architecture is required.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. It is intended that the scope of the invention be defined by the claims appended hereto.

We claim:

1. An audio headset, comprising:

a headband having a housing defining a first axis along a length of the housing;

an ear pod having a portion affixed within the housing of the headband, the ear pod mounted for translation along an exterior of the housing, the ear pod including a speaker, a second axis being defined orthogonal to the first axis and substantially perpendicular to a major planar surface of the ear pod; and a microphone affixed to the headband at the ear pod, wherein the microphone is mounted for rotation about the second axis.

2. The headset of claim 1, the microphone mounted on a boom, wherein the boom is mounted to the headset coaxially with the ear pod.

3. The headset of claim 2, wherein the microphone is further mounted for rotation about the first axis.

4. The headset of claim 3, wherein the boom is capable of bending about the first axis.

5. The headset of claim 1, further comprising a wired connection to one of a controller and a computing device.

6. The headset of claim 1, further comprising a wireless connection to one of a controller and a computing device.

7. The headset of claim 1, wherein the headset is connected to a game controller via a volume controller, the volume controller controlling a volume to the ear pod and a mute function for muting the microphone.

8. An audio headset, comprising:

a headband having a portion defining a first axis along a length of the portion;

a housing affixed at the portion of the headband, the housing having a cover with an elongate slot formed along the first axis;

a slide mounted within the housing;

a slide base affixed to the slide;

an ear pod including a speaker, the ear pod affixed to the slide base, the slide, slide base and ear pod capable of translating together along the first axis along the length of the slot, and the slide, slide base and ear pod capable of rotating together around the first axis within the slot, a second axis being defined orthogonal to the first axis and substantially perpendicular to a major planar surface of the ear pod; and a microphone affixed to the ear pod, wherein the microphone is mounted for rotation relative to the ear pod about the second axis.

9. The headset of claim 8, wherein the microphone is further mounted for rotation about the first axis.

10. The headset of claim 8, wherein the microphone is affixed to the ear pod via a boom.

11. The headset of claim 10, wherein the boom is capable of bending about the first axis.

12. The headset of claim 10, wherein the boom includes a circular base affixing the boom and microphone to the ear pod.

13. The headset of claim 12, further comprising an o-ring between the circular base of the boom and the ear pod to hold the microphone and boom in a fixed position absent an external biasing force.

14. The headset of claim 8, wherein the speaker is housed within the ear pod between an ear pad for resting against an ear of a user and an ear pod cover.

15. The headset of claim 14, wherein the microphone is affixed to the ear pod via a boom, the ear pod cover includes a boss on a first side for rotatably supporting a circular base of the boom.

16. The headset of claim 15, wherein the ear pod cover further includes a groove on a second side of the ear pod cover opposite the first side, the housing seated within the groove.

17. A headset assembly, comprising:

a headset, comprising:

a headband having a portion defining a first axis along a length of the portion, the portion including a housing, a slide mounted to translate entirely within the housing, an ear pod affixed to the slide in the housing at the portion of the headband, the ear pod including a speaker and mounted for translation with the slide along the axis and rotation on the slide about the axis, a second axis being defined orthogonal to the first axis and substantially perpendicular to a major planar surface of the ear pod, and a microphone affixed to the headband at the ear pod, wherein the microphone is mounted for rotation about the first and second axes; and a volume controller for controlling a volume to the ear pod and a mute function for muting the microphone.

18. The headset assembly of claim 17, wherein the volume controller is connected to the headset by a cord.

19. The headset assembly of claim 17, wherein the volume controller communicates with the headset by a wireless communications interface.

20. The headset assembly of claim 17, wherein the volume controller plugs into a game controller, the game controller transferring audio to and from the headset.

* * * * *